US008408740B2

(12) United States Patent
Barnwell et al.

(10) Patent No.: US 8,408,740 B2
(45) Date of Patent: Apr. 2, 2013

(54) LUMINAIRE ASSEMBLIES AND APPLICATIONS THEREOF

(75) Inventors: David Barnwell, Northhampton (GB); David Javes, Bucks (GB)

(73) Assignee: ABL IP Holding LLC, Conyers, GA (US)

( * ) Notice: Subject to any disclaimer, the term of this patent is extended or adjusted under 35 U.S.C. 154(b) by 399 days.

(21) Appl. No.: 12/899,174

(22) Filed: Oct. 6, 2010

(65) Prior Publication Data

US 2011/0110086 A1 May 12, 2011

Related U.S. Application Data

(60) Provisional application No. 61/248,950, filed on Oct. 6, 2009.

(51) Int. Cl.
*F21V 21/00* (2006.01)

(52) U.S. Cl. ..... 362/249.02; 362/147

(58) Field of Classification Search ..... 362/478, 362/147, 249.02, 254, 368
See application file for complete search history.

(56) References Cited

U.S. PATENT DOCUMENTS

2012/0327641 A1* 12/2012 Holder et al. ..... 362/184

FOREIGN PATENT DOCUMENTS

EP 2 309 171 4/2011

OTHER PUBLICATIONS

Communication Pursuant to Rule 58 EPC or Rule 159 EPC for European Patent Application No. EP 10251752.1-2423, mailed Nov. 23, 2010 (3 pages).
Response to Communication Pursuant to Rule 58 EPC or Rule 159 EPC for European Patent Application No. EP 10251752.1-2423, field Dec. 6, 2010 (3 pages).
Response to Communication Pursuant to Rule 58 EPC or Rule 159 EPC for European Patent Application No. EP 10251752.1-2423, filed Jan. 6, 2011 (13 pages).
Goddard, et al., "Lighting of London Under Ground Assets," London Underground Limited, No. 2-01105-002, Issue No. A1, Apr. 2005 (12 pages).
"Cool-LED Switchable LED Drivers," Harvard Engineering Plc, www.harvardeng.com, undated (1 page).

* cited by examiner

*Primary Examiner* — David V Bruce
(74) *Attorney, Agent, or Firm* — Kilpatrick Townsend & Stockton LLP

(57) ABSTRACT

The present invention provides luminaire light source assemblies incorporating LEDs as light sources for use in various lighting applications.

24 Claims, 12 Drawing Sheets

| Intensity Distribution | | Intensity Distribution | | Intensity Distribution | | Intensity Distribution | |
|---|---|---|---|---|---|---|---|
| | Horizontal Angle | | Horizontal Angle | | Horizontal Angle | | Horizontal Angle |
| Vertical Angle | 0 | Vertical Angle | 0 | Vertical Angle | 0 | Vertical Angle | 0 |
| 0 | 20 | 45 | 59 | 90 | 36 | 135 | 9 |
| 2.5 | 20 | 47.5 | 68 | 92.5 | 15 | 137.5 | 9 |
| 5 | 21 | 50 | 79 | 95 | 11 | 140 | 10 |
| 7.5 | 21 | 52.5 | 90 | 97.5 | 7 | 142.5 | 11 |
| 10 | 22 | 55 | 112 | 100 | 6 | 145 | 11 |
| 12.5 | 22 | 57.5 | 134 | 102.5 | 5 | 147.5 | 11 |
| 15 | 21 | 60 | 156 | 105 | 3 | 150 | 11 |
| 17.5 | 19 | 62.5 | 179 | 107.5 | 2 | 152.5 | 11 |
| 20 | 22 | 65 | 219 | 110 | 2 | 155 | 12 |
| 22.5 | 25 | 67.5 | 259 | 112.5 | 3 | 157.5 | 12 |
| 25 | 26 | 70 | 306 | 115 | 3 | 160 | 14 |
| 27.5 | 27 | 72.5 | 353 | 117.5 | 3 | 162.5 | 15 |
| 30 | 30 | 75 | 366 | 120 | 4 | 165 | 19 |
| 32.5 | 33 | 77.5 | 380 | 122.5 | 4 | 167.5 | 22 |
| 35 | 37 | 80 | 302 | 125 | 5 | 170 | 30 |
| 37.5 | 41 | 82.5 | 224 | 127.5 | 6 | 172.5 | 38 |
| 40 | 45 | 85 | 141 | 130 | 7 | 175 | 43 |
| 42.5 | 49 | 87.5 | 58 | 132.5 | 8 | 177.5 | 49 |
| 45 | 59 | 90 | 36 | 135 | 9 | 180 | 49 |

FIG. 3 (continued)

| Intensity Distribution | | | | | |
|---|---|---|---|---|---|
| | Horizontal Angle | | | | |
| Vertical Angle | 0 | 45 | 90 | 135 | 180 |
| 0 | 236 | 236 | 236 | 236 | 236 |
| 5 | 35 | 246 | 239 | 375 | 422 |
| 10 | 118 | 208 | 311 | 429 | 502 |
| 15 | 69 | 51 | 298 | 582 | 608 |
| 20 | 52 | 86 | 341 | 707 | 749 |
| 25 | 57 | 45 | 435 | 837 | 851 |
| 30 | 42 | 59 | 579 | 1060 | 1051 |
| 35 | 41 | 38 | 671 | 1353 | 1266 |
| 40 | 46 | 71 | 834 | 1804 | 1274 |
| 45 | 21 | 80 | 1136 | 2238 | 1639 |
| 50 | 23 | 41 | 1541 | 3036 | 2101 |
| 55 | 18 | 58 | 2100 | 3832 | 2792 |
| 60 | 24 | 63 | 2477 | 4425 | 3233 |
| 65 | 16 | 43 | 2966 | 4812 | 3144 |
| 70 | 9 | 31 | 3210 | 5936 | 4937 |
| 75 | 0 | 40 | 3028 | 6553 | 8200 |
| 80 | 0 | 35 | 1161 | 3340 | 3127 |
| 85 | 0 | 70 | 386 | 1018 | 485 |
| 90 | 0 | 30 | 360 | 349 | 243 |

FIG. 7 (continued)

LUMINAIRE ASSEMBLIES AND APPLICATIONS THEREOF

RELATED APPLICATION DATA

The present application hereby claims the benefit of U.S. Provisional Patent Application Ser. No. 61/248,950, filed Oct. 6, 2009, which is hereby incorporated by reference in its entirety.

FIELD OF THE INVENTION

The present invention relates to luminaire assemblies and, in particular, to luminaire assemblies operable to interface with existing luminaire infrastructure.

BACKGROUND OF THE INVENTION

Luminaires for providing general illumination to an area are well known and often used in outdoor lighting applications including roadway and sidewalk lighting, parking lot lighting, and residential area lighting. Luminaires also find use in underground applications, such as in the lighting of tunnels, shafts and platforms.

Currently available luminaires incorporate various light sources including incandescent, fluorescent, halogen, high intensity discharge and light emitting diodes (LEDs). Incandescent light sources are highly inefficient due to significant amounts of energy dissipated as heat. Moreover, although more efficient than incandescent light sources, fluorescent lamps can suffer shorter lifetimes depending on operating environment factors.

Comparatively, LED light sources offer several advantages including high lighting efficiency, long lifetimes, typically between 10,000 and 60,000 hours of operation, resistance to physical or mechanical shock and rapid lighting response time. Long lifetimes are an attractive property of LEDs for underground lighting applications. In underground transportation systems such as subways and train tunnels, for example, replacement of luminaire light sources is costly as replacement procedures often require closing of underground passageways. Closing passageways of underground transportation systems can potentially result in disruption of services and loss of revenue. As a result, long lifetime luminaire light sources are generally desirable.

Nevertheless, LEDs exhibit several disadvantages which challenge their use in luminaire constructions, including luminaires used for underground lighting applications. The performance of an LED, for example, is largely dependent on the temperature of the operating environment. Operating an LED in high ambient temperatures can lead to overheating and device failure. Moreover, LEDs generally project a narrow field of light in comparison with other light sources. As a result, it can be difficult to achieve sufficient illumination over a wide area with LED sources. Furthermore, narrow field light projection can lead to glare capable of interfering with the sight of personnel operating machinery in an underground passageway and can eliminate the stroboscopic effect associated with other light sources/control gear.

SUMMARY

In view of the foregoing, the present invention provides luminaires and luminaire light source assemblies incorporating LEDs. In some embodiments, luminaires and luminaire light source assemblies described herein can overcome disadvantages that have limited or precluded the use of LEDs in underground lighting applications.

Moreover, in some embodiments, luminaires and luminaire light source assemblies of the invention are operable to interface with existing luminaire infrastructure and serve as replacement assemblies for less efficient, damaged or broken luminaires currently in use in underground lighting applications. The ability of luminaire light source assemblies described herein, for example, to interface with existing luminaire infrastructure, in some embodiments, permits the in-situ replacement of light sources of less efficient, damaged or broken luminaires currently in use in underground lighting applications with higher efficiency and longer lifetime LEDs.

In one embodiment, the present invention provides a luminaire light source assembly comprising a gear tray, a plurality of light emitting diodes (LEDs) coupled to one or more surfaces of the gear tray and a plurality of LED optics, wherein the light source assembly provides a standard horizontal illuminance of at least 5 lux from the luminaire in which it is positioned. In some embodiments, a luminaire light source assembly provides a standard horizontal illuminance of at least 10 lux from the luminaire. In some embodiments, a luminaire light source assembly provides a standard horizontal illuminance of at least 20 lux from the luminaire.

In some embodiments, a luminaire light source assembly described herein comprising a plurality of LEDs and a plurality of LED optics can replace existing light sources of luminaires used in underground applications, including compact fluorescent light sources.

Moreover, in some embodiments, a luminaire light source assembly further comprises one or more outer optics operable to work in conjunction with the plurality of LED optics to provide a standard horizontal illuminance of at least 10 lux from a luminaire. In some embodiments, the one or more outer optics is provided by the luminaire receiving the light source assembly. In other embodiments, a luminaire light source assembly comprises one or more outer optics independent of the luminaire receiving the assembly.

In another aspect, the present invention provides a luminaire comprising a gear tray, a plurality of LEDs coupled to one or more surfaces of the gear tray, a plurality of inner LED optics and an outer optic, wherein the luminaire has a standard horizontal illuminance of at least 5 lux. In some embodiments, the luminaire has a standard horizontal luminance of at least 10 lux. In some embodiments, the luminaire has a standard horizontal luminance of at least 20 lux.

The present invention, in another aspect, provides methods of replacing a light source of a luminaire. In one embodiment, a method of replacing a light source of a luminaire comprises removing the light source from the luminaire architecture and interfacing a light source assembly with the luminaire architecture, the light source assembly comprising a gear tray, a plurality of LEDs coupled to one or more surfaces of the gear tray and a plurality of LED optics, wherein the light source assembly provides a standard horizontal illuminance of at least 5 lux from the luminaire. In some embodiments, the luminaire is part of an underground lighting system, such as in underground transportation systems.

In some embodiments, the ability of a luminaire light source assembly described herein to interface with a pre-existing luminaire architecture permits the in-situ replacement of light sources of luminaires used in underground lighting applications. As a result, less efficient, broken or damaged luminaire light sources can be replaced or retrofit with LED light sources without having to remove the luminiare from its installed position in the underground application.

DETAILED DESCRIPTION

Figure 1:
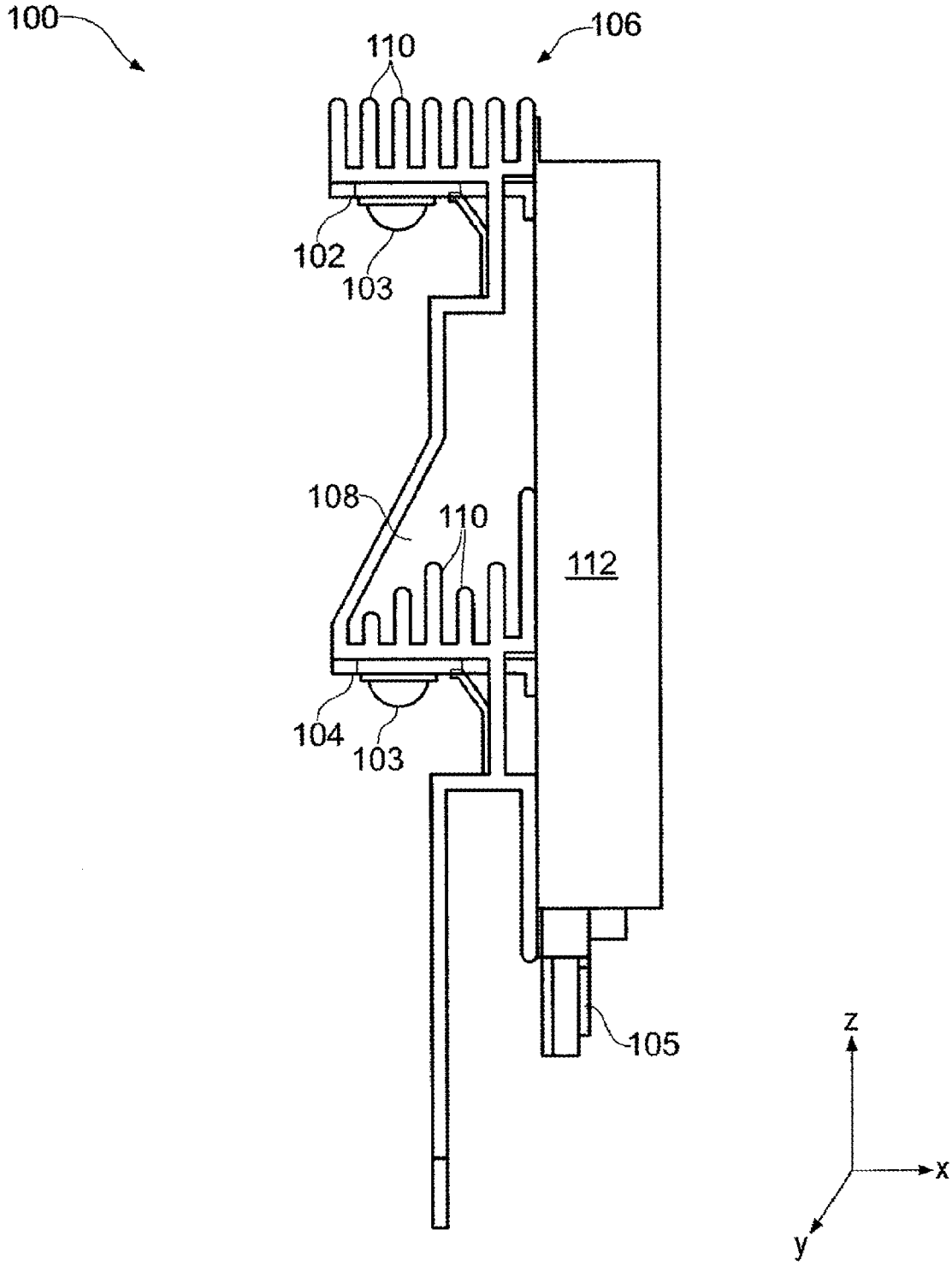
FIG. 1 illustrates an elevational view of a luminaire light source assembly according to one embodiment of the present invention.

The present invention can be understood more readily by reference to the following detailed description and drawings and their previous and following descriptions. Elements, apparatus and methods of the present invention, however, are not limited to the specific embodiments presented in the detailed description and drawings. It should be recognized that these embodiments are merely illustrative of the principles of the present invention. Numerous modifications and adaptations will be readily apparent to those of skill in the art without departing from the spirit and scope of the invention.

The present invention provides luminaires and luminaire light source assemblies incorporating LEDs for use in various underground lighting applications. In some embodiments, luminaires and luminaire light source assemblies described herein can overcome disadvantages that have limited or precluded the use of LEDs in underground lighting applications.

Moreover, in some embodiments, luminaires and luminaire light source assemblies of the invention are operable to interface with existing luminaire infrastructure and serve as replacement assemblies for less efficient, damaged or broken luminaires currently in use in underground lighting applications. The ability of luminaire light source assemblies described herein, for example, to interface with existing luminaire infrastructure, in some embodiments, permits the in-situ replacement of light sources of less efficient, damaged or broken luminaires currently in use in underground lighting applications with higher efficiency and longer lifetime LEDs.

In one embodiment, the present invention provides a luminaire light source assembly comprising a gear tray, a plurality of LEDs coupled to one or more surfaces of the gear tray and a plurality of LED optics, wherein the light source assembly provides a standard horizontal illuminance of at least 5 lux from the luminaire. In some embodiments, a luminaire light source assembly provides a standard horizontal illuminance of at least 10 lux from the luminaire. In some embodiments, a luminaire light source assembly provides a standard horizontal illuminance of at least 20 lux from the luminaire. In some embodiments, a luminaire light source assembly provides a standard horizontal illuminance from the luminaire ranging from 10 lux to 50 lux or from 20 lux to about 40 lux. In some embodiments, a luminaire light source assembly provides a standard horizontal illuminance from the luminaire ranging from 15 lux to 30 lux.

Standard horizontal illuminance, as used herein, refers to the luminous flux incident on a horizontal surface 1.4 to 1.8 meters below the luminaire and 1.0 to 1.5 meters in front of the luminaire as determined according to Lighting of London Underground Assets No. 2-01105-002, Issue No. A1, Issue date—April 2005.

A luminaire light source assembly, in some embodiments, can have any desired number of LEDs to achieve the illuminance values recited herein. In some embodiments, a luminaire light source assembly comprises at least 5 LEDs. In some embodiments, a luminaire light source assembly comprises at least 7 LEDs. A luminaire light source assembly, in some embodiments, comprises at least 10 LEDs. In some embodiments, a luminaire light source assembly comprises 5 to 15 LEDs or 10 to 20 LEDs.

In some embodiments, LEDs of a luminaire light source assembly are coupled to one or more surfaces of the gear tray. A luminaire light source assembly can have any arrangement of LEDs operable to provide a luminaire the standard horizontal illuminance values recited herein. In some embodiments, the plurality of LEDs are arranged in one or more arrays on the gear tray. In one embodiment, for example, the plurality of LEDs of a luminaire light source assembly are arranged on the gear tray in two linear arrays, each linear array comprising at least 5 LEDs. In another embodiment, the plurality of LEDs are arranged on the gear tray in two linear arrays, each linear array comprising at least 7 LEDs.

Moreover, in some embodiments, the plurality of LEDs are arranged into one or more shapes on the gear tray including, but not limited to, circular, elliptical, triangular, square or rectangular or polygonal. In some embodiments, the plurality of LEDs demonstrate a random arrangement on the gear tray.

FIG. 1 illustrates an elevational view of a luminaire light source assembly according to one embodiment of the present invention. As illustrated in FIG. 1, the gear tray (100) comprises two bracket mounting surfaces (102, 104) for receiving a plurality of LEDs (103) in a linear array format. In the embodiment illustrated in FIG. 1, the two bracket mounting surfaces (102, 104) are parallel or substantially parallel to a horizontal surface (not shown) to be illuminated by the luminaire light source assembly. As a result, the plurality of LEDs (103) coupled to the bracket mounting surfaces (102, 104) face the horizontal surface to be illuminated. Having the LEDs face one or more horizontal surfaces to be illuminated, such as floors of train running tunnels and platforms, can assist in reducing glare generated from the LEDs. In some embodiments, for example, luminaires comprising light source assemblies described herein are compliant with the provisions of EN 1838, Emergency Lighting.

The gear tray (100) further comprises heat sinks (106, 108) adjacent to the bracket mounting surfaces (102, 104). Heat sinks (106, 108) comprise a plurality of fins (110) that assist in maintaining the LEDs at an acceptable operating temperature by dissipating heat generated by the LEDs. A gear tray can have any desired number of fins (110) for assisting in the dissipation of heat generated by operation of the LEDs. The fins (110) can have any desired shape or construction. In some embodiments, the fins (110) are tapered. In some embodiments, the fins (110) are planar. In some embodiments, the fins (110) are curved. Moreover, in some embodiments, at least two of the fins (110) have unequal heights. In some embodiments, the fins (110) have the same or substantially the same height.

The gear tray (100) additionally comprises plug circuitry (105) for interfacing with existing luminaire power infrastructure. In some embodiments, for example, the gear tray (100) can simply plug into circuitry of a power source used by a light source being replaced.

Moreover, the gear tray (100) is coupled to LED driver circuitry (112) for operation of the LEDs coupled to the bracket mounting surfaces (102, 104). Any LED driver circuitry not inconsistent with the objectives of the present invention can be used. In some embodiments, for example, the LED driver circuitry is compliant with one or more electromagnetic compatibility (EMC) requirements of an underground transportation system, including the EMC requirements of the London Underground. In some embodiments, suitable LED driver circuitry is commercially available from Harvard Engineering PLC of Leeds, England.

In some embodiments, the LED is disposed in a metal casing. Additionally, in some embodiments, the LED driver circuitry provides an output current of about 450 mA. The LED driver circuitry, in some embodiments, comprises architecture resistant to various voltage surges.

Figure 2:
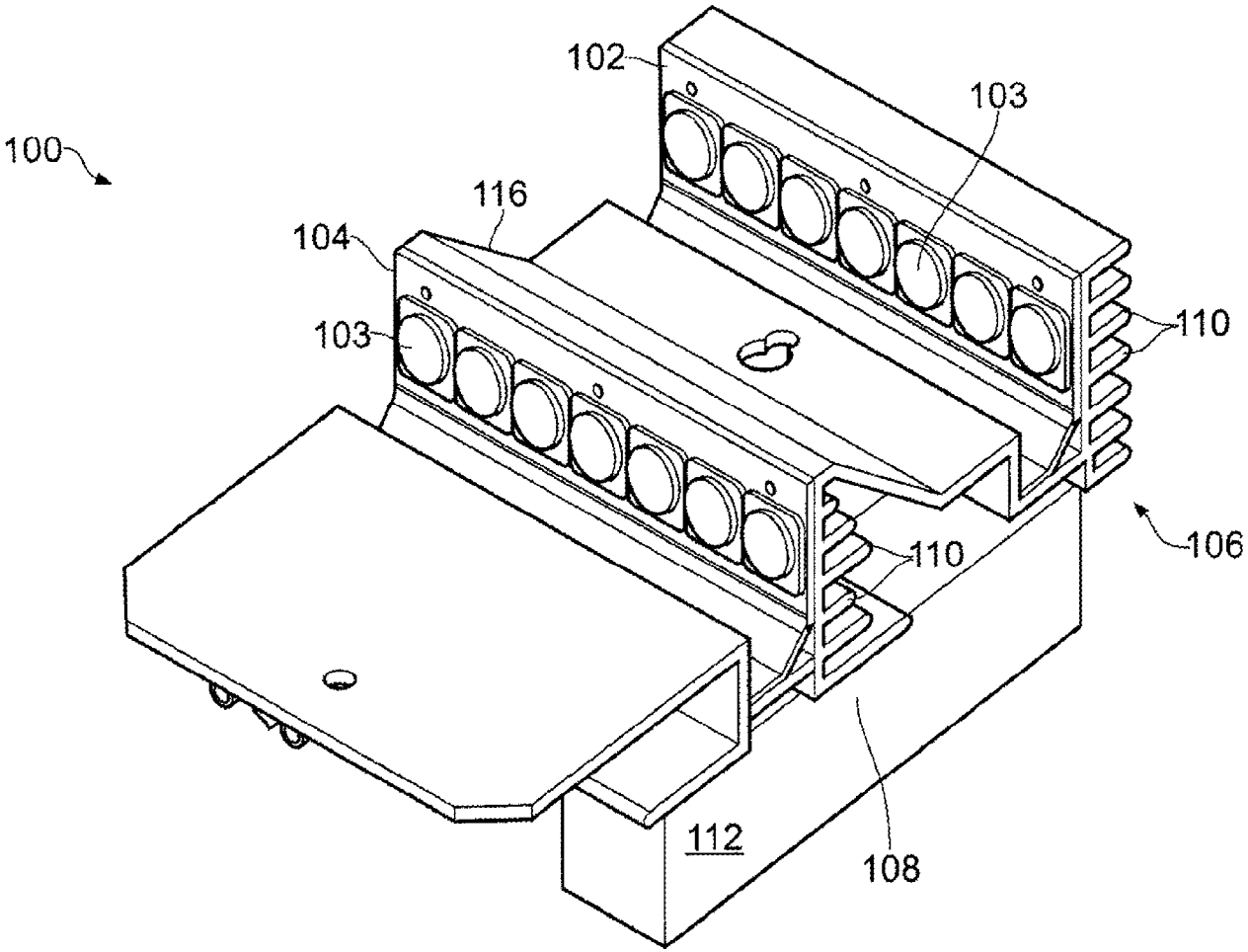
FIG. 2 illustrates a perspective view of a luminaire light source assembly according to one embodiment of the present invention.

FIG. 2 illustrates a perspective view of the gear tray (100) of FIG. 1. In the embodiment displayed in FIG. 2, the plurality of fins (110) of heat sinks (106, 108) are commensurate with the width of the gear tray to maximize surface area for heat dissipation. In other embodiments, however, fins of heat sinks or other structures do not span the width of the gear tray. Additionally, an inclined plane (116) is disposed between LED bracket mounting surfaces (102, 104), the bracket mounting surfaces (102, 104) each comprising a one-dimensional array of LEDs (103). The inclined plane (116) assists in accommodating the fins (110) of heat sink (108) while maintaining the monolithic structure of the gear tray (100). The inclined plane, in some embodiments, does not affect or substantially affect the light distribution of the luminaire light source assembly. In some embodiments, the inclined plane can assist in altering the light distribution form the luminaire light source assembly.

Figure 10:
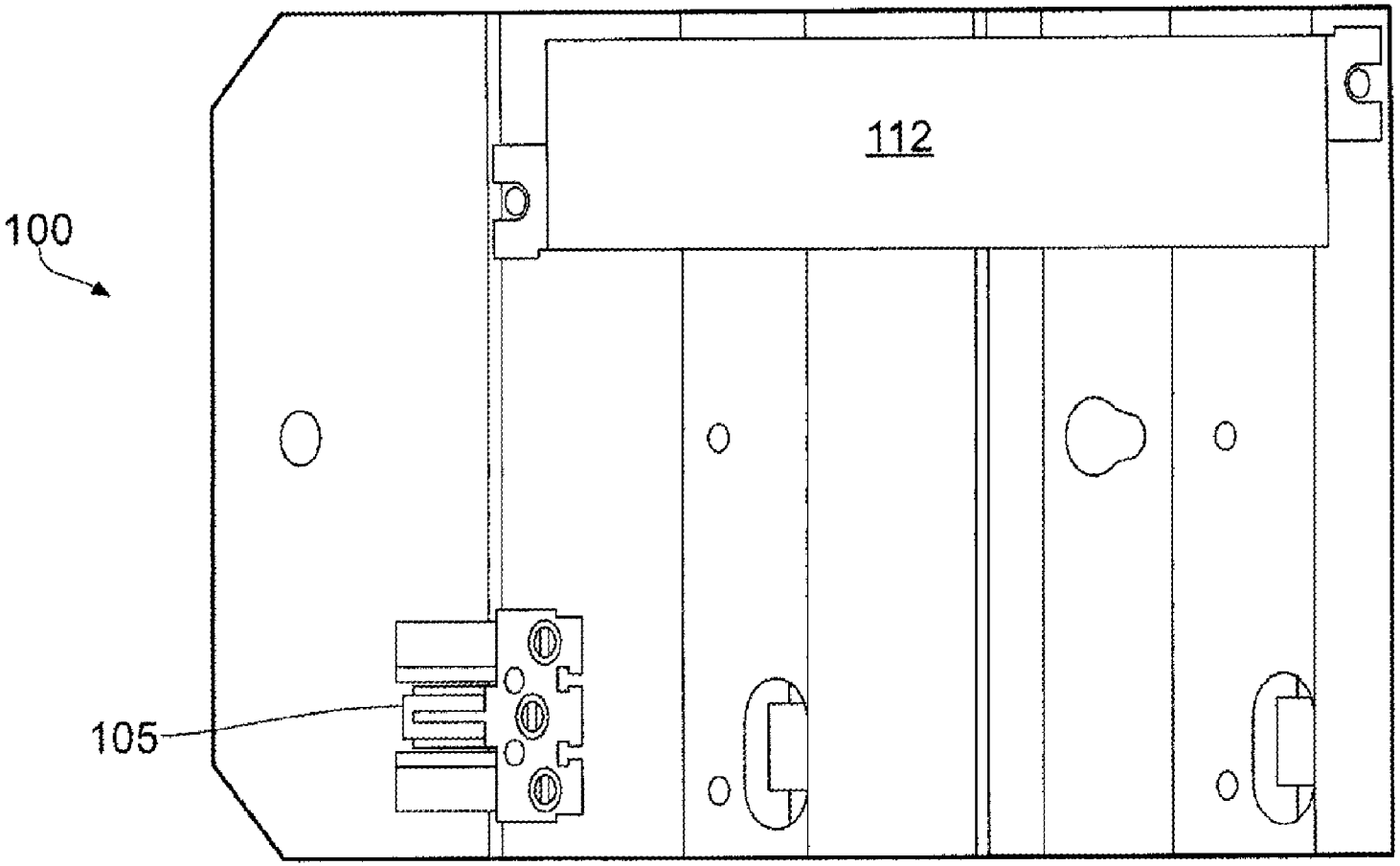
FIG. 10 illustrates a plan view of the back of a luminaire light source assembly according to one embodiment of the present invention.

FIG. 10 illustrates a plan view of the back of the luminaire light source assembly of FIG. 1. As illustrated in FIG. 10, the gear tray (100) of the luminaire light assembly comprises plug circuitry (105) for interfacing with existing luminaire power infrastructure. In some embodiments, for example, the gear tray (100) can plug into circuitry of a power source used by a light source being replaced. Moreover, the gear tray (100) is coupled to LED driver circuitry (112) for operation of the LEDs.

A gear tray of a luminaire light source assembly can be constructed of any material not inconsistent with the objectives of the present invention. In some embodiments, a gear tray is constructed of a polymeric material. In some embodiments, a gear tray is constructed of a fiber reinforced polymeric material, including glass fiber reinforced polymeric materials. Luminaire light source assemblies and luminaires of the present invention, in some embodiments, are compliant with the provisions of the United Kingdom Fire Precautions (Sub-surface Railway Station) Regulations of 1989 introduced under Section 12 of the Fire Precautions Act of 1971.

As provided herein, a luminaire light source assembly also comprises a plurality LED optics. In some embodiments, the plurality of LED optics work in conjunction with one or more optics of an existing luminaire to provide a standard horizontal illuminance described herein from the luminaire. In one embodiment, for example, the plurality of LED optics work in conjunction with a single outer optic of an existing luminaire to provide a standard horizontal illuminance of at least 10 lux from the luminaire. Existing luminaires, in some embodiments, comprise luminaires already installed and/or in use in underground lighting applications.

In some embodiments, an individual LED optic is associated with each of the plurality of LEDs coupled to one or more surfaces of the gear tray. In one embodiment, for example, a LED optic is disposed over each LED of the gear tray. In some embodiments, a LED optic is coupled to the gear tray over a LED. A LED optic can be snapped into place over a LED or coupled to the gear tray by some other form of mechanical engagement. In other embodiments, a LED optic is chemically adhered or bonded to the gear tray over a LED.

Figure 3:
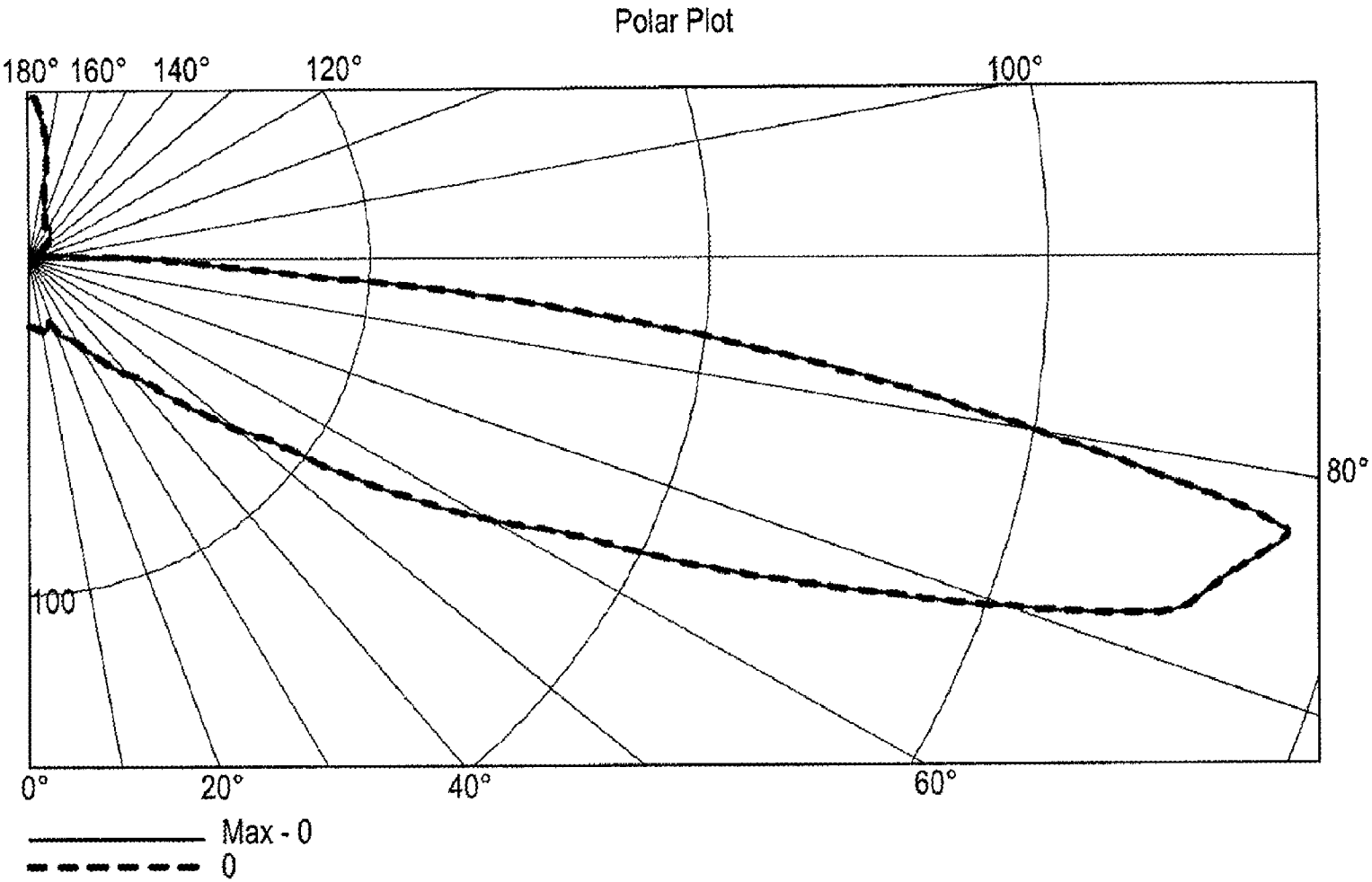
FIG. 3 provides a polar plot illustrating the light distribution of a LED in conjunction with a LED optic according to one embodiment of the present invention.

LED optics, in some embodiments, can increase the horizontal or substantially horizontal distribution of light emitted from a LED. FIG. 3 provides a polar plot illustrating the light distribution of a LED in conjunction with a LED optic according to one embodiment of the present invention. As illustrated in FIG. 3, the light distribution is substantially horizontal having a maximum intensity at a vertical angle of 77.5 degrees. In some embodiments, a LED in conjunction with a LED optic has a light distribution having a maximum intensity at a vertical angle up to 80 degrees or up to 75 degrees. In some embodiments, a LED in conjunction with a LED optic has a light distribution having a maximum intensity at a vertical angle up to 70 degrees.

The ability of an LED optic to increase the horizontal or substantially horizontal distribution of light emitted from a LED, in some embodiments, contributes to the ability of the luminaire light source assembly to provide a standard horizontal illuminance of at least 10 lux from the luminaire.

Figure 4:
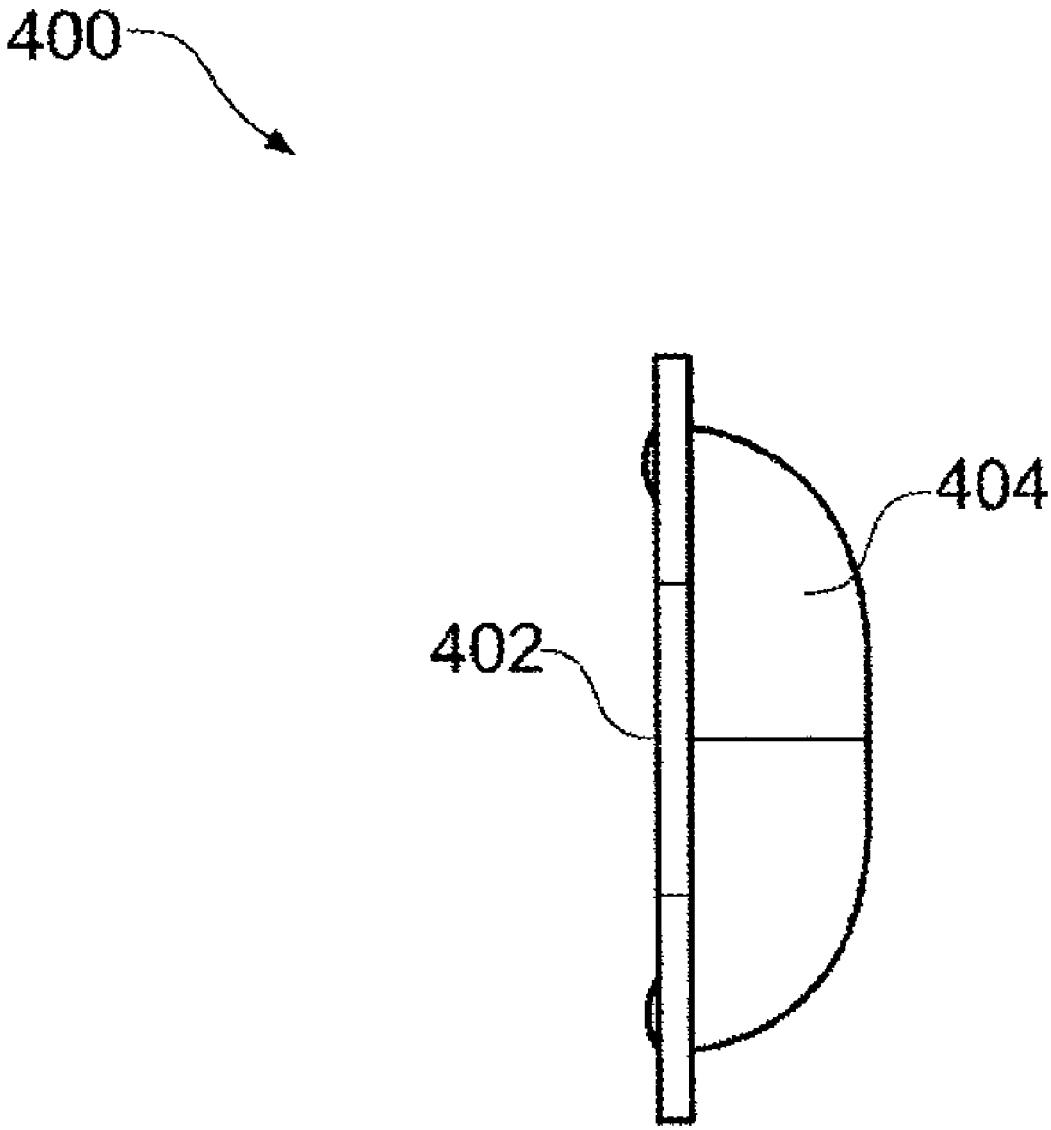
FIG. 4 illustrates an elevational view of a LED optic according to one embodiment of the present invention.
Figure 5:
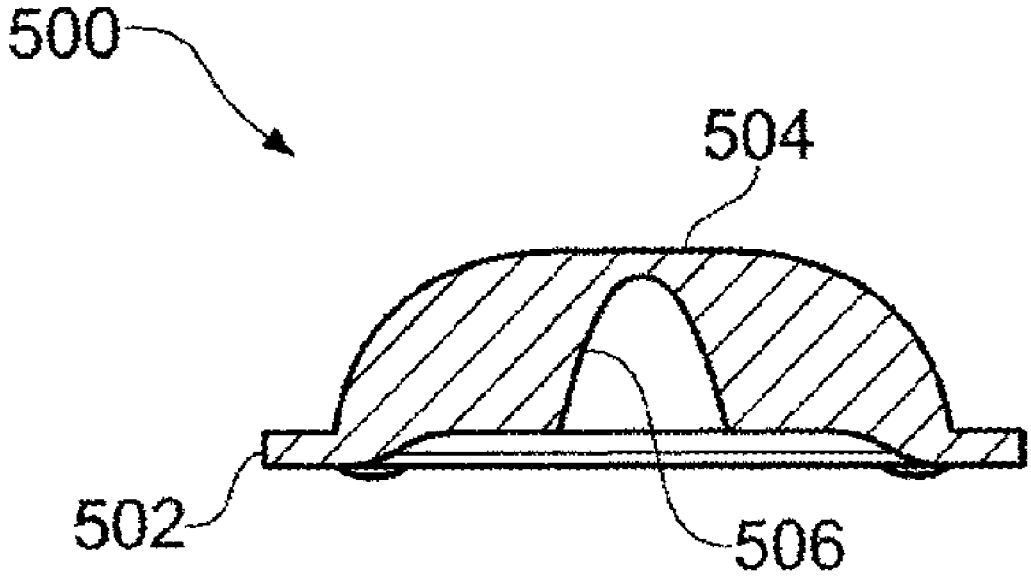
FIG. 5 illustrates a cross-sectional view of a LED optic according to one embodiment of the present invention.

FIG. 4 illustrates an elevational view of an LED optic according to one embodiment of the present invention. The LED optic (400) comprises a base (402) and an optical structure (404). The base (402) of the LED optic (400) can couple to a surface of the gear tray or other structure when the LED optic (400) is disposed over a LED. Moreover, FIG. 5 illustrates a cross-sectional view of a LED optic according to one embodiment of the present invention. The LED optic (500) comprises a base (502) and an optical structure (504). The optical structure (504) in the embodiment illustrated in FIG. 5 demonstrates a variable thickness. The variable thickness of the optical structure (504) provides a cavity (506).

LEDs and LED optics suitable for use in luminaire light source assemblies described herein, in some embodiments, are commercially available from Phillips Lumileds Lighting Company of San Jose, Calif. under the LUXEON® Rebel product designation. In some embodiments, LEDs suitable for use in luminaire light source assemblies of the present invention have a lifetime of up to 50,000 hours, thereby reducing the frequency of underground luminaire maintenance resulting from expired light sources.

As provided herein, LED optics of a luminaire light source assembly, in some embodiments, work in conjunction with one or more optics of an existing luminaire to provide a standard horizontal illuminance value recited herein.

Figure 6:
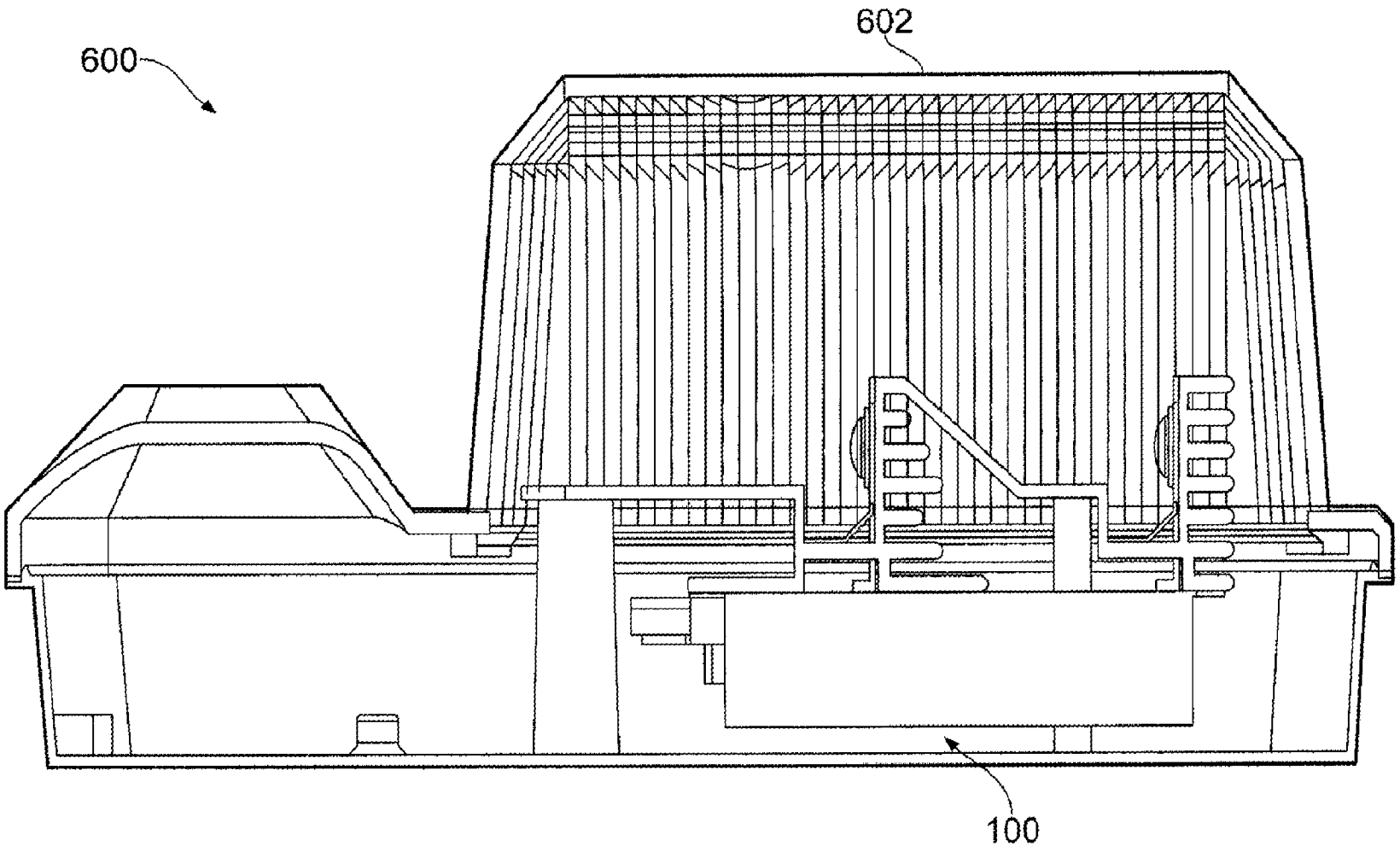
FIG. 6 illustrates a cut away view of a luminaire according to one embodiment of the present invention.

FIG. 6 illustrates a cut away view of a luminaire light source assembly of the present invention interfaced with an existing luminaire (600) having an outer optic (602). As described herein, an existing luminaire can comprise luminaires already installed and/or in use in underground lighting applications. The gear tray (100) provided in FIGS. 1 and 2 herein is disposed in the existing luminaire (600) and plugs into the power circuitry (not shown) of the luminaire for operation of the LEDs. The outer optic (602), in some embodiments, can work in conjunction with one or a plurality of LED optics of the light source assembly to provide a standard horizontal illuminance of at least 10 lux from the luminaire.

In some embodiments, at least one LED optic of a light source assembly and at least one optic of a luminaire receiving the assembly work in conjunction to provide a LED light distribution from the luminaire having a maximum intensity at a vertical angle of up to about 80 degrees. In some embodiments, at least one LED optic of a light source assembly and at least one optic of a luminaire receiving the assembly work in conjunction to provide a LED light distribution from the luminaire having a maximum intensity at a vertical angle of up to about 75 degrees or up to about 70 degrees. In some embodiments, at least one LED optic and at least one optic of an existing luminaire work in conjunction to provide a LED light distribution from the luminaire having a maximum intensity at a vertical angle ranging from about 60 degrees to about 80 degrees.

Figure 7:
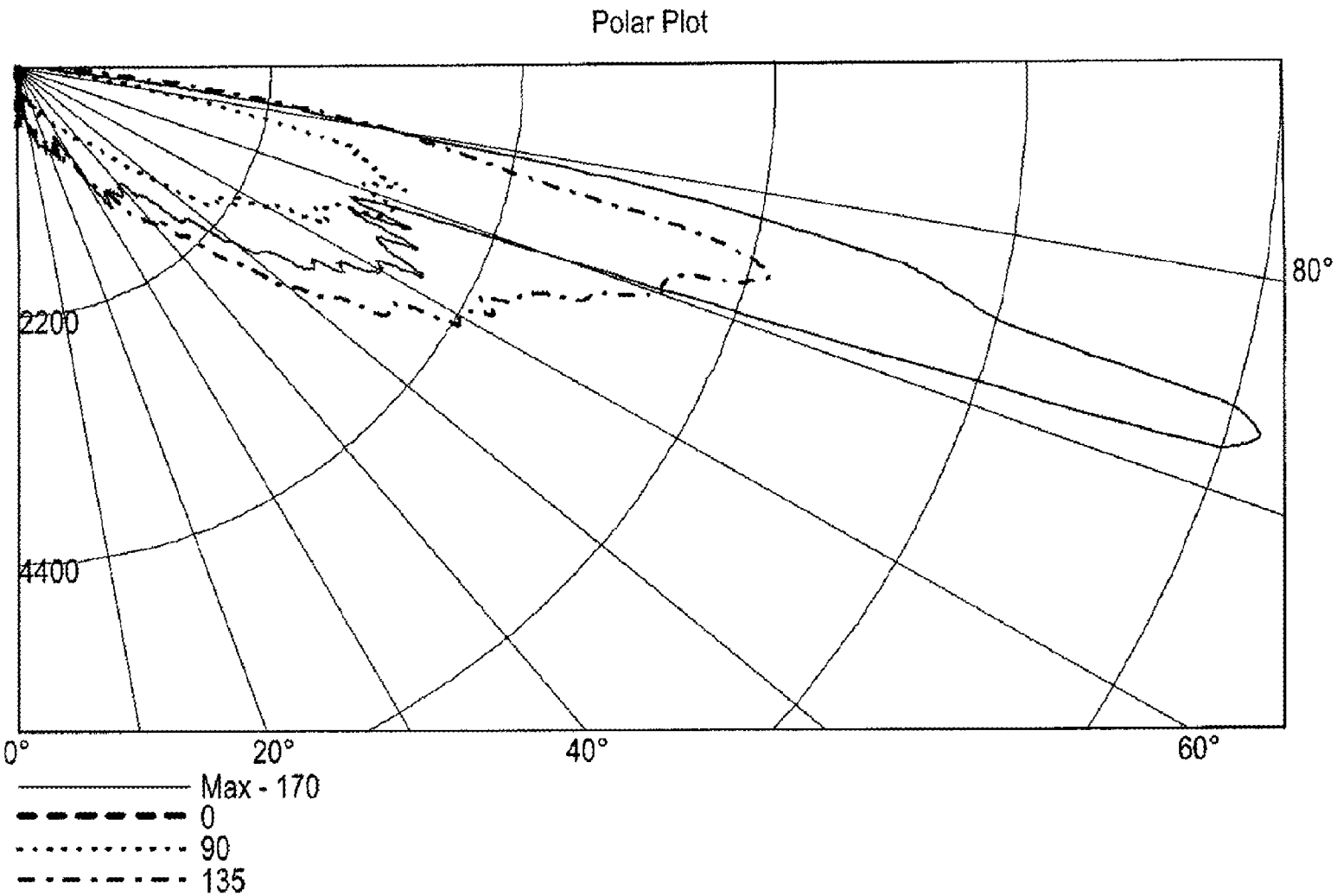
FIG. 7 provides a polar plot illustrating the light distribution from a luminaire according to one embodiment of the present invention.

FIG. 7 provides a polar plot illustrating the light distribution of a luminaire comprising a light source assembly according to one embodiment of the present invention. As demonstrated in FIG. 7, the plurality of LED optics of the light source assembly and the outer optic of the luminaire work together to provide a LED light distribution from the luminaire having a maximum intensity at a vertical angle ranging from about 60 degrees to about 80 degrees.

In some embodiments described herein, the light distribution provided by the plurality of LED optics working in conjunction with one or more outer optics assist in achieving a standard horizontal illuminance of at least 10 lux from the luminaire.

Any design and/or configuration of a luminaire light source assembly comprising a gear tray, a plurality of LEDs and LED optics in conjunction with one or more optics of a luminaire operable to provide a standard horizontal illuminance value described herein are contemplated by the present invention. In some embodiments one or more outer optics of a luminaire comprise prismatic structures.

In one embodiment, for example, LEDs and LED optics commercially available under the LUXEON® Rebel product designation are coupled to a gear tray in a linear array format as illustrated in FIGS. 1 and 2 herein. The gear tray is disposed in an existing METROLUX™ luminaire commercially available from Holophane Europe Limited of Buckinghamshire, England. The LED optics work in conjunction with the outer optic of the METROLUX™ luminaire to provide a standard horizontal illuminance value recited herein from the luminaire. In some embodiments, for example, the LED optics work in conjunction with the with the outer optic of the METROLUX™ luminaire to provide a standard horizontal illuminance of at least 5 lux or at least 10 lux from the luminaire.

In another embodiment, for example, LEDs and LED optics commercially available under the LUXEON® Rebel product designation are coupled to a gear tray in a linear array format as illustrated in FIGS. 1 and 2 herein. The gear tray is disposed in an existing WIDERLIGHT™ luminaire commercially available from Holophane Europe Limited of Buckinghamshire, England. The LED optics work in conjunction with the outer optic of the WIDERLIGHT™ luminaire to provide a standard horizontal illuminance value recited herein from the luminaire. In some embodiments, the LED optics work in conjunction with the with the outer optic of the WIDERLIGHT™ luminaire to provide a standard horizontal illuminance of at least 5 lux or at least 10 lux from the luminaire.

In another aspect, the present invention provides a luminaire comprising a gear tray, a plurality of LEDs coupled to one or more surfaces of the gear tray, a plurality of inner LED optics and an outer optic, wherein the luminaire has a standard horizontal illuminance of at least 5 lux. In some embodiments, the luminaire has a standard horizontal illuminance of at least 10 lux. In some embodiments, the luminaire has a standard horizontal illuminance of at least 20 lux.

In some embodiments, the gear tray, LEDs and LED optics of the luminaire are consistent with any of the same described herein for the luminaire light source assembly.

Moreover, the outer optic of the luminaire, in some embodiments, comprises any design and/or configuration operable to work in conjunction with one or more LED optics to achieve a standard horizontal illuminance described herein. In some embodiments, an outer optic comprises a plurality of prismatic surface structures.

Figure 8:
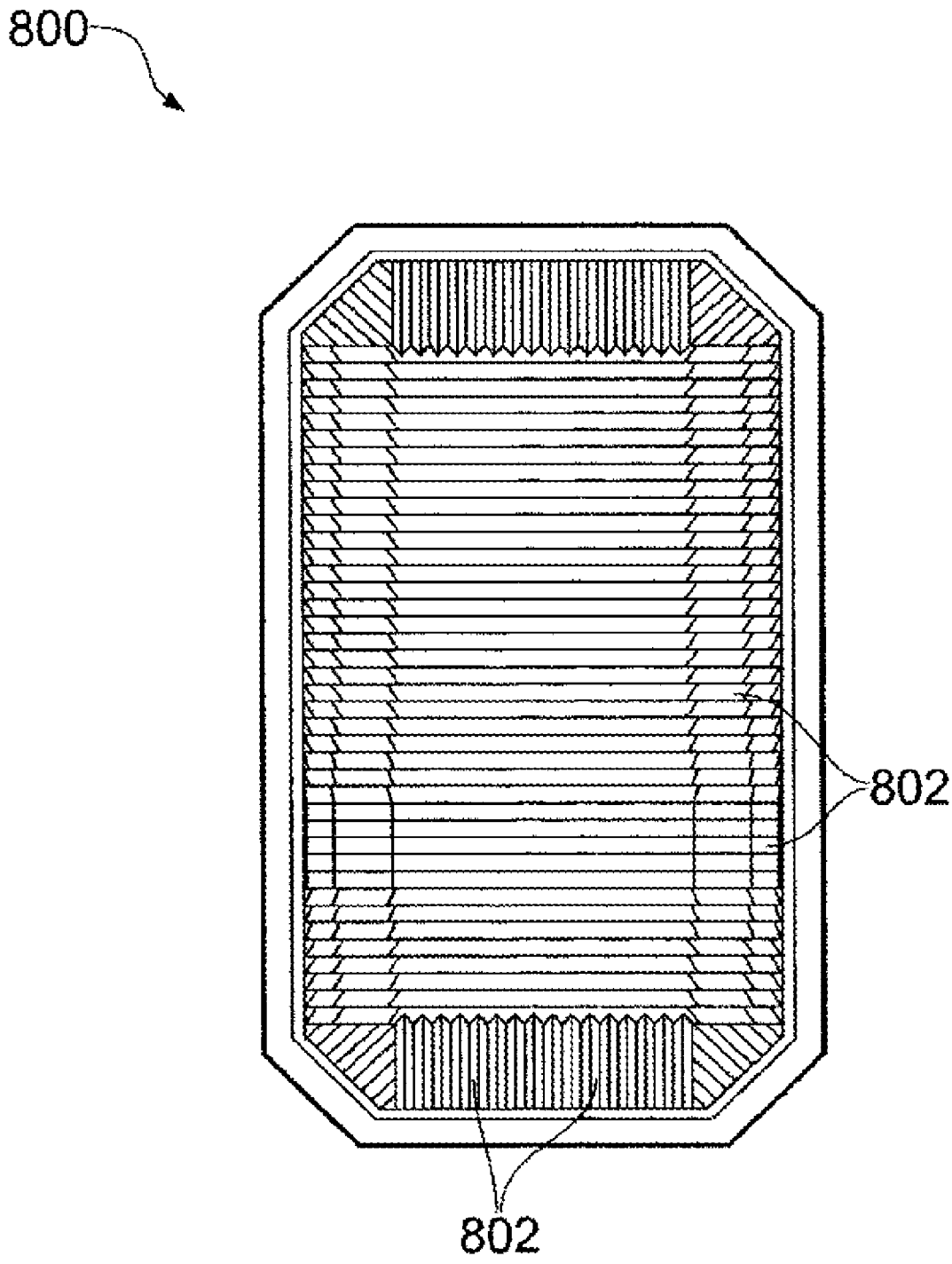
FIG. 8 illustrates a bottom plan view of an outer optic of a luminaire according to one embodiment of the present invention.

FIG. 8 illustrates a bottom plan view of an outer optic according to one embodiment of the present invention. The outer optic (800) of FIG. 8 comprises surfaces comprising prismatic structures (802). In some embodiments, an outer optic is commercially available from Holophane Europe Limited under the METROLUX™ and WIDERLIGHT™ product designations.

In some embodiments, an outer optic is constructed of any material not inconsistent with the objectives of the present invention. In some embodiments, an outer optic of a luminaire is constructed of glass. In some embodiments, glass comprises pressed borosilicate glass. In other embodiments, the outer optic is constructed of a polymeric material.

Figure 9:
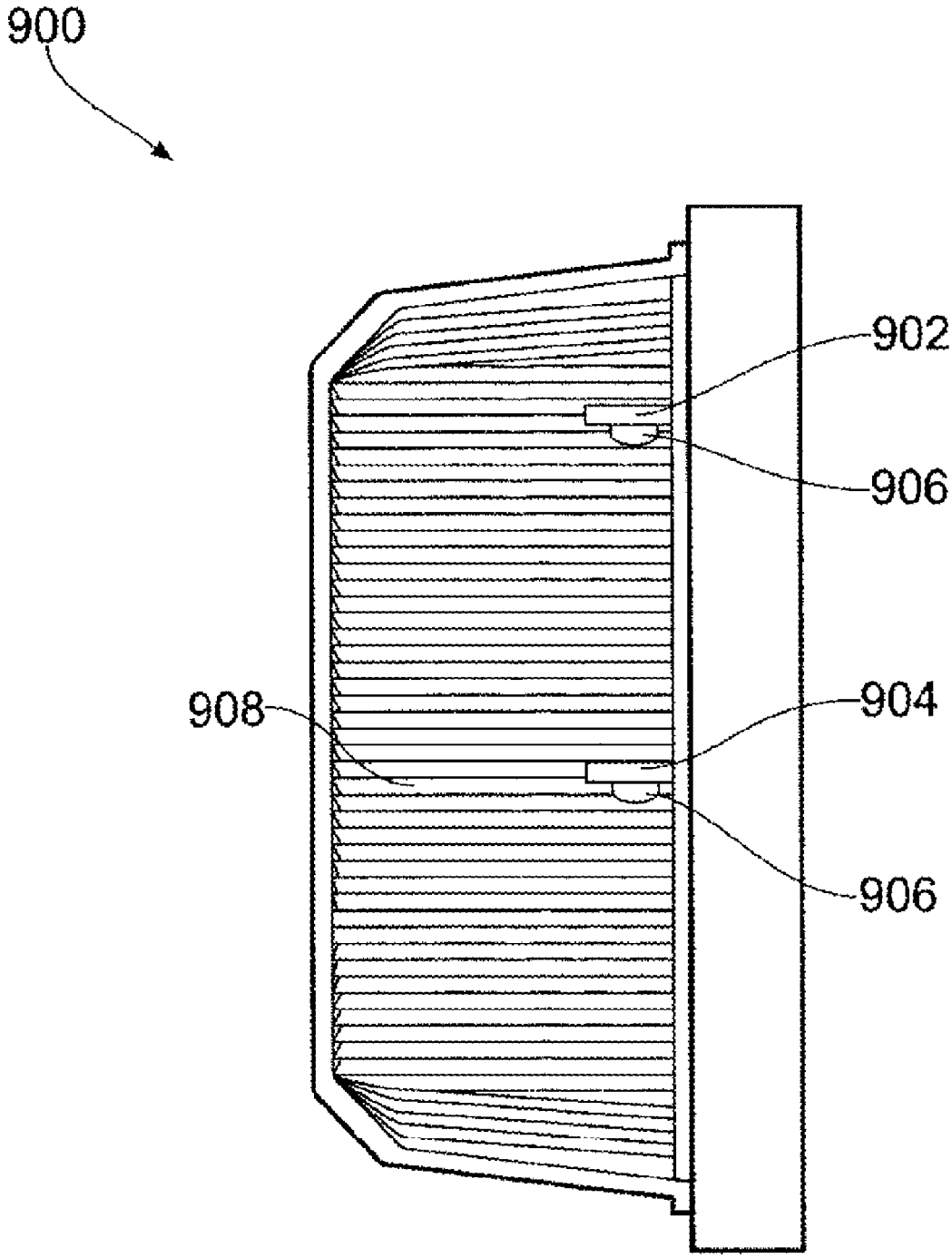
FIG. 9 illustrates an elevational view of a luminaire according to one embodiment of the present invention.

FIG. 9 illustrates a luminaire according to one embodiment of the present invention. The luminaire (900) of FIG. 9 comprises a gear tray comprising two bracket mounting surfaces (902, 904) for receiving a plurality of LEDs and LED optics (906) in a linear array format. The outer optic (908) of the luminaire works in conjunction with LED optics (906) to provide the luminaire a standard horizontal illuminance value described herein.

As provided herein, luminaires of the present invention are suitable for use in underground lighting applications. In some embodiments, luminaires are used in the lighting of underground transportation tunnels, including running tunnels, crossover and junction tunnels. Luminaires described herein can additionally find application in cable shafts, ventilation shafts, lift pits and shafts.

The present invention, in another aspect, provides methods of replacing a light source of a luminaire in an underground lighting application. In one embodiment, a method of replacing a light source of luminaire in an underground lighting application comprises removing the light source from the luminaire architecture and interfacing a light source assembly with the luminaire architecture, the light source assembly comprising a gear tray, a plurality of LEDs coupled to one or more surfaces of the gear tray and a plurality of LED optics, wherein the light source assembly provides a standard horizontal illuminance of at least 5 lux from the luminaire. In some embodiments, the light source assembly provides a standard horizontal illuminance of at least 10 lux from the luminaire. In some embodiments, the light source assembly provides a standard horizontal illuminance of at least 20 lux from the luminaire.

In some embodiments, a luminaire light source replaced according to methods described herein comprises a incandescent light source or a fluorescent light source.

In some embodiments, the ability of a luminaire light source assembly to interface with an existing luminaire architecture permits the in-situ replacement of light sources of luminaires used in underground lighting applications. As a result, less efficient, broken or damaged luminaire light sources can be replaced with LED light sources without having to remove the luminiare from its installed position in the underground application. In some embodiments, for example, the outer optic of a luminaire can be removed or opened to expose the light source to be replaced. The light source can be removed from the luminaire architecture, and a luminaire light source assembly comprising a gear tray, a plurality of LEDs and LED optics can be coupled to the luminaire architecture without any modifications of the luminaire architecture and/or conversion apparatus.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, the present invention is not limited to the particular embodiments disclosed, but is intended to cover modifications that are within the spirit and scope of the invention.

That which is claimed is:

1. A luminaire light source assembly comprising:

a gear tray;

a plurality of light emitting diodes (LED) coupled to one or more surfaces of the gear tray; and a plurality of LED optics, wherein the light source assembly provides a standard horizontal illuminance of at least 5 lux from the luminaire.

2. The luminaire light source assembly of claim 1, wherein the light source assembly provides a standard horizontal illuminance of at least about 10 lux from the luminaire.

3. The luminaire light source assembly of claim 1, wherein the LEDs are coupled to a surface of the gear tray substantially parallel to a horizontal surface illuminated by the luminaire light source assembly.

4. The luminaire light source assembly of claim 1, wherein the LEDs are coupled to a first mounting surface and a second mounting surface of the gear tray in an array format.

5. The luminaire light source assembly of claim 4, wherein the first mounting surface and the second mounting surface are substantially parallel to a horizontal surface illuminated by the luminaire.

6. The luminaire light source assembly of claim 5, wherein the first mounting surface is closer to the horizontal surface than the second mounting surface.

7. The luminaire light source assembly of claim 1, wherein a LED in conjunction with a LED optic has a light distribution having a maximum intensity at a vertical angle less than 80 degrees.

8. The luminaire light source assembly of claim 1, wherein a LED in conjunction with a LED optic has a light distribution having a maximum intensity at a vertical angle less than 75 degrees.

9. The luminaire light source assembly of claim 1 further comprising LED driver circuitry coupled to the gear tray.

10. The luminaire light source assembly of claim 1 further comprising plug circuitry.

11. A luminaire comprising:

a luminaire light source assembly comprising a gear tray, a plurality of light emitting diodes (LED) coupled to one or more surfaces of the gear tray and a plurality of LED optics; and an outer optic, wherein the luminaire has a standard horizontal illuminance of at least 5 lux.

12. The luminaire of claim 11, wherein the luminaire has a standard horizontal illuminance of at least 10 lux.

13. The luminaire of claim 11, wherein the luminaire has a standard horizontal illuminance of at least 20 lux.

14. The luminaire of claim 11, wherein the LEDs are coupled to a surface of the gear tray substantially parallel to a horizontal surface illuminated by the luminaire light source assembly.

15. The luminaire of claim 11, wherein the luminaire has a light distribution having a maximum intensity at a vertical angle up to about 80 degrees.

16. The luminaire of claim 11, wherein the luminaire has a light distribution having a maximum intensity at a vertical angle ranging from 60 degrees to 80 degrees.

17. The luminaire of claim 11, wherein the luminaire light source assembly is a replacement light source for the luminaire.

18. The luminaire of claim 17, wherein the luminaire is part of an underground lighting system.

19. A method of replacing a light source of a luminaire comprising:

removing the light source from the luminaire architecture;

interfacing a light source assembly with the luminaire architecture, the light source assembly comprising a gear tray, a plurality of LEDs coupled to one or more surfaces of the gear tray and a plurality of LED optics, wherein the light source assembly provides a standard horizontal illuminance of at least 5 lux from the luminaire.

20. The method of claim 19, wherein the luminaire is part of a underground lighting system.

21. The method of claim 19, wherein the light source assembly provides a standard horizontal illuminance of at least 10 lux from the luminaire.

22. The method of claim 19, wherein the light source assembly provides a standard horizontal illuminance of at least 20 lux from the luminaire.

23. The method of claim 19, wherein the luminaire comprising the light source assembly has a light distribution having a maximum intensity at a vertical angle up to about 80 degrees.

24. The method of claim 19, wherein the luminaire comprising the light source assembly has a light distribution having a maximum intensity at a vertical angle ranging from 60 degrees to 80 degrees.

* * * * *